US006508302B2

(12) United States Patent
Ishida et al.

(10) Patent No.: US 6,508,302 B2
(45) **Date of Patent: *Jan. 21, 2003**

(54) HEAT PIPE AND METHOD FOR PROCESSING THE SAME

(75) Inventors: Yoshio Ishida, Osaka (JP); Akimi Shutou, Osaka (JP)

(73) Assignee: Diamond Electric Mfg. Co. Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/205,382

(22) Filed: Dec. 4, 1998

(65) Prior Publication Data

US 2001/0047859 A1 Dec. 6, 2001

(51) Int. Cl.[7] ..... F28D 15/00
(52) U.S. Cl. ..... 165/104.26; 165/104.21
(58) Field of Search ..... 165/104.26, 104.21, 165/104.33, 46 H

(56) References Cited

U.S. PATENT DOCUMENTS

| | | | | | |
|---|---|---|---|---|---|
| 3,680,189 | A | * | 8/1972 | Noren | 165/104.26 |
| 3,700,028 | A | * | 10/1972 | Noren | 165/104.26 |
| 3,831,664 | A | * | 8/1974 | Pogson | 165/104.26 |
| 4,007,781 | A | * | 2/1977 | Masters | 165/46 |
| 4,019,571 | A | * | 4/1977 | Kosson et al. | 165/104.26 |
| 4,394,344 | A | * | 7/1983 | Werner et al. | 165/104.26 |
| 4,640,347 | A | * | 2/1987 | Grover et al. | 165/104.26 |
| 4,899,812 | A | * | 2/1990 | Altoz | 165/46 |
| 5,029,389 | A | * | 7/1991 | Tanzer | 29/890.32 |
| 5,046,553 | A | * | 9/1991 | Lindner | 165/104.26 |
| 5,465,782 | A | * | 11/1995 | Sun et al. | 165/104.26 |
| 5,579,828 | A | * | 12/1996 | Reed et al. | 165/104.21 |
| 5,603,375 | A | * | 2/1997 | Salt | 165/46 |
| 5,694,295 | A | * | 12/1997 | Mochizuki et al. | 165/104.33 |
| 5,880,524 | A | * | 3/1999 | Xie | 257/704 |

FOREIGN PATENT DOCUMENTS

| | | | | |
|---|---|---|---|---|
| EP | 0702287 A2 | * | 5/1990 | 165/104.26 |
| WO | WO9005380 | * | 5/1990 | 165/104.33 |

* cited by examiner

*Primary Examiner*—Henry Bennett
*Assistant Examiner*—Tho Duong
(74) *Attorney, Agent, or Firm*—Liniak, Berenato & White

(57) ABSTRACT

A heat pipe comprising a flat container, and a member selected from a rod, a plate and a mesh, the member being fixedly arranged between narrow walls of the container so that space is provided in the inner circumference of the container both in the direction of width and length of the container.

3 Claims, 7 Drawing Sheets

HEAT PIPE AND METHOD FOR PROCESSING THE SAME

BACKGROUND OF THE INVENTION

The present invention relates to a heat-radiation heat pipe particularly used in an information electronic appliance, or the like, and a method for processing the same.

In information electronic appliances such as a notebook type personal computer, etc., the heating density of electronic parts such as an MPU, etc., becomes very high with development of complexity while satisfying demands for reduction of weight and thickness. To comply with the demands, it has become to use a thin plate type heat pipe for radiation of heat from the aforementioned heating parts.

To finish the heat pipe to be thin, it is necessary not only to reduce the required heat flow rate in the vapor passage of the operating fluid substantially to a limit, but also to put a core at the time of processing to control the accuracy of the inner area and to finish the thickness of the container material to be very small.

However, even in the case where the above-mentioned ideas are executed, there is naturally a limit to the reduction of thickness because the container must bear both mechanical pressure from the outside and inner pressure accompanying the two-phase change of vapor and liquid and because some liquid reservoirs caused by the starting characteristic of the heat pipe are generated partially in the axial direction of the heat pipe to thereby cause increase of heat resistance. Accordingly, conventionally, no material having a smaller thickness than about 1.5 mm could be provided.

SUMMARY OF THE INVENTION

The present invention is designed to solve the aforementioned problem and it is an object of the present invention to provide a heat pipe in which a good effect can be obtained even in the case where the heat pipe has a thickness not larger than 1 mm, and a method for processing the same.

To solve the aforementioned problem, according to the present invention, a core, which has been generally taken in or out whenever processing is performed, is designed to be left in the heat pipe whenever the heat pipe is processed, as a structure optimum to a wick which is put in a heat pipe for circulation of an operating fluid. Accordingly, it is made possible to provide a very thin heat pipe having a thickness not larger than 1 mm and excellent both in heat transport ability and in heat resistance property.

That is, the invention provides a heat pipe comprising a flat container, and a member selected from a rod, a plate and a mesh, the member being fixedly arranged between narrow walls of the container so that space is provided in the inner circumference of the container both in the direction of width and length of the container; another embodiment of the invention provides a heat pipe comprising: a first pipe; at least one second pipe having a relatively small diameter and a relatively short length compared with the first pipe, the at least one second pipe being inserted in the first pipe so as to be fixed substantially at a center portion of the first pipe, the first and second pipes being flattened; and an operating fluid put into the first pipe, the heat pipe being sealed at its opposite ends; in a heat pipe according to the present invention the second pipe may be formed from a mesh or a braided wire; furthermore in a heat pipe according to the present invention the second pipe is deformed like a pair of spectacles in section; in a heat pipe according to the present invention the inside of the first pipe is grooved; and in a heat pipe according to yet another embodiment of the present invention the inside of the container is grooved or provided with mesh.

Further, in accordance with the present invention provided is a method for processing a heat pipe by using a first pipe, a second pipe having a relatively small diameter and a relatively short length compared with the first pipe, and an arbor, comprising the steps of inserting at least one second pipe in the first pipe so as to be temporarily fixed substantially at a center portion of the first pipe by using the arbor, pressing the first pipe to flatten the first pipe to thereby fix the second pipe to the inner wall of the first pipe, taking out the arbor; putting an operating fluid into the first pipe, and sealing end portions of the first pipe; furthermore provided is a method for processing a heat pipe by using a first pipe, a second pipe having a relatively small diameter and a relatively short length compared with the first pipe, and an arbor, comprising the steps of inserting at least one second pipe in the first pipe so as to be temporarily fixed substantially at a center portion of the first pipe by using the arbor, pressing the first pipe to flatten the first pipe to thereby fix the second pipe to the inner wall of the first pipe, taking out the arbor; pressing the second pipe again to deform the second pipe to be like a pair of spectacles in section while leaving at least an injection portion, putting an operating fluid into the first pipe, and sealing an end portion of the first pipe; and also, provided is a method for processing a heat pipe by using a first pipe, a second pipe having a relatively small diameter and a relatively short length compared with the first pipe, and an arbor, comprising the steps of inserting at least one second pipe in the first pipe so as to be temporarily fixed substantially at a center portion of the first pipe by using the arbor, pressing the first pipe to flatten the first pipe to thereby fix the second pipe to the inner wall of the first pipe, taking out the arbor, processing the second pipe to flatten the second pipe while leaving at least an injection portion is left, putting an operating fluid into the first pipe, and sealing an end portion of the first pipe.

Further, yet another embodiment of the present invention, provided is a heat pipe comprising flat container, and a depressed wall, in which the depressed all is formed by depression of at least one surface substantially in the center portion so that space is provided in the inner circumference of the container both in the direction of width and length of the container; furthermore, provided is a heat pipe used in an electronic appliance, wherein one end of a container is throttled as an operating fluid injection hole, the other end of the container is pressed or welded so as to be sealed, at least one surface of the container forms a depressed wall having a smaller length than the axial length, the depressed wall is brought into contact with a counter wall so that a loop-like heat pipe is formed by the depressed wall and the inner wall of the container, and the injection hole is sealed after an operating fluid is injected; moreover, in a heat pipe according to the present invention, the operating fluid is enclosed by an amount not smaller than 25% of an inner volume of space of the container; also, in a heat pipe according to the present invention, at least a part of the inside of the container is provided with a wick grooved or formed of mesh; and in addition, a heat pipe according to the present invention, at least a part between the depressed wall and a counter wall is welded.

Further, provided is a method for processing a heat pipe, wherein at least one surface of a round rod-like heat pipe is depressed substantially at a center portion thereof when or after the round rod-like heat pipe is pressed so as to be flattened; in a method for processing a heat pipe according to the present invention, the heat pipe is kept at a temperature not lower than 50□C; in claim 17, provided is a heat pipe characterized in that the heat pipe comprises a flat first pipe, and at least two depressed walls formed by pressing a flat surface of the first pipe in the axial direction so that operating fluid passages are formed by the depressed walls; and in a heat pipe according to yet another embodiment of the present invention, a wick material is provided in the operating fluid passages formed by the depressed walls except operating fluid passages located in end portions.

DETAILED DESCRIPTION OF THE PREFERRED EMBODIMENTS

Figure 1:
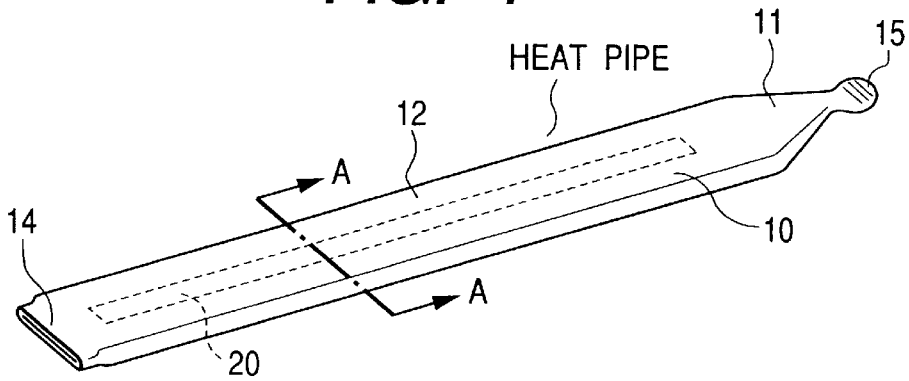
FIG. 1 is a perspective view of a heat pipe as an embodiment of the present invention.
Figure 2:
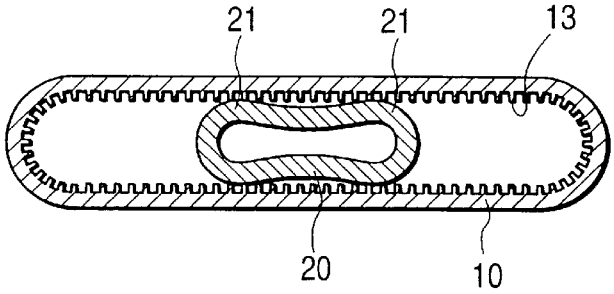
FIG. 2 is a section of the heat pipe, as the first embodiment of the present invention, along the A—A ling viewed in the direction of the arrow in FIG. 1.

FIG. 1 is an overall view of a first embodiment of the present invention. In FIG. 1, the broken line shows the position of a wick which serves also as a core. The wick is disposed substantially in the center portion. A detailed sectional view of the embodiment is shown in FIG. 2.

Figure 3:
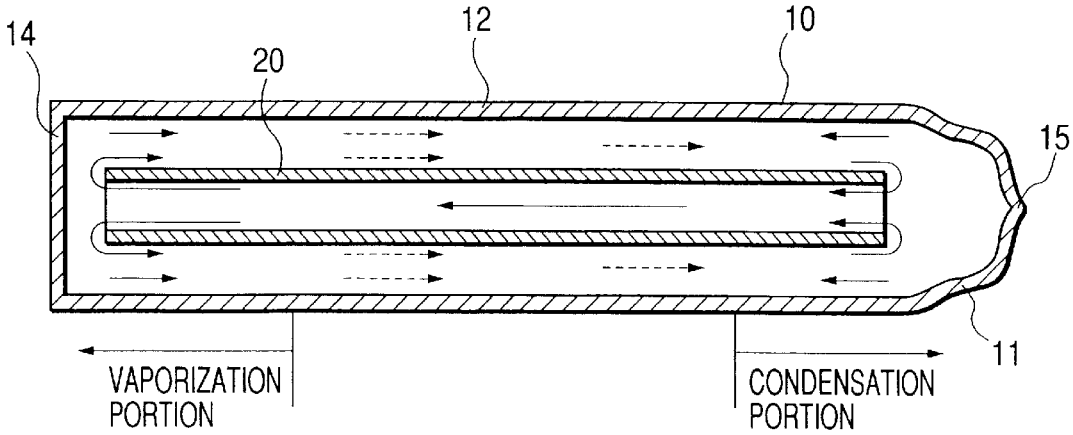
FIG. 3 is a section, as the first embodiment of the present invention, viewed in the axial direction in FIG. 1.

FIG. 1 is an overall perspective view of a heat pipe as a first embodiment of the present invention; FIG. 2 is a section along the A—A line of the heat pipe viewed in the direction of the arrow in FIG. 1; and FIG. 3 is an axial section of the heat pipe depicted in FIG. 1. Referring to these drawings, a first pipe 10 is formed of a tubular material having a hollow in its inside. Axially end portions of the first pipe 10 are provided as a throttled portion 11 and a pressed portion 14 respectively, so that a container 12 is formed between the opposite end portions. The throttled portion 11 serves as an operating fluid injection hole. A seal portion 15 is formed in an assembling process so that the inside of the first pipe 10 is sealed up. Further, as shown in FIG. 2, in the inside of the first pipe 10, grooves 13 are formed and a second pipe 20 having a smaller length than the effective length of the container 12 is buried. As shown in FIG. 2, the axial shape of the second pipe 20 is like spectacles having a pair of circular arc portions 21. Here, the grooves 13 form a groove wick of the first pipe 10 and the second pipe 20 forms a pipe wick.

In a more specific example, the first pipe 10 is formed of a pipe material of oxygen-free copper or phosphor-deoxidized copper having a thickness of about 0.18 mm and an outer diameter of from about 3 mm to about 15 mm, the pipe material being cut into a length of about 180 mm and processed to form grooves with a height of about 0.12 mm in the inner surface of the pipe material. The second pipe 20 is formed of oxygen-free copper or phosphor-deoxidized copper having a thickness of from 0.12 mm to 0.25 mm and an outer diameter of from about 1.2 mm to about 3 mm, the pipe material being cut into a smaller length than the effective length of the container 12 in the first pipe 10.

Figure 4:
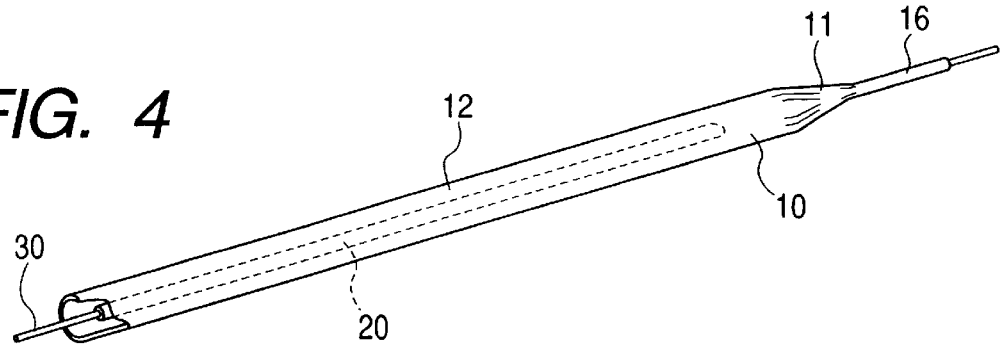
FIG. 4 is a perspective view showing the case where a heat sink according to the first embodiment of the present invention is produced.
Figure 5:
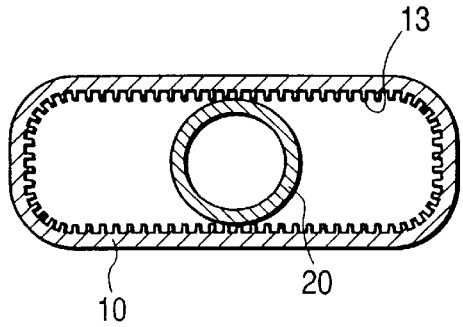
FIG. 5 is a section along the A—A line viewed in the direction of the arrow in FIG. 6.
Figure 6:
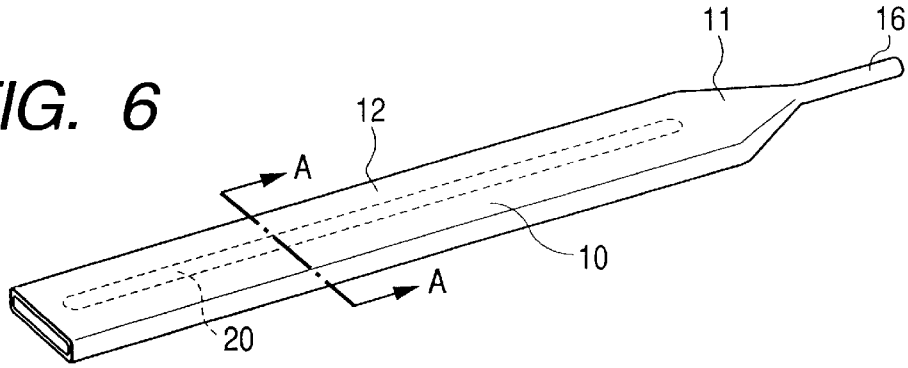
FIG. 6 is a perspective view of the heat pipe of the first embodiment after the heat pipe is temporarily pressed.

A method for processing the heat pipe according to the present invention will be described below with reference to FIGS. 4 through 7. FIG. 4 is a view showing the case where an end portion of the first pipe 10 is throttled; FIG. 6 is a view showing the case where the first pipe 10 in FIG. 4 is temporarily pressed so that the second pipe 20 is fixed into the inside. of the first pipe 10; FIG. 5 is a section along the A—A line viewed in the direction of the arrow in FIG. 6; and FIG. 7 is a view showing the case where the first pipe 10 depicted in FIG. 6 is further pressed.

In FIG. 4, one end portion of the first pipe 10 is throttled to reduce its diameter for injecting an operating fluid, so that a throttled portion 11 and an operating fluid injection hole 16 are formed. Then, an arbor 30 of piano wire or phosphor bronze is put through the first pipe 10 from the other end portion of the first pipe 10, the second pipe 20 is inserted in the inside of the container 12 and the pipes 10 and 20 are set to a pressing jig. Then, the second pipe 20 is temporarily fixed substantially at the center portion of the inside of the container 12 as shown in FIG. 4. While this state is kept, the second pipe 20 is temporarily pressed with size control in which the contour of the second pipe 20 is fixed to the inner wall of the first pipe 10. After a shape shown in FIG. 6 and having a sectional state shown in FIG. 5 is thus obtained, the arbor 30 is taken out.

Now, the container 12 having a wick structure intended by the present invention can be finished. Accordingly, if the container 12 is finished to have a target thickness, a heat pipe is completed by the steps of: pressing an end portion which has not been throttled yet; welding or brazing the end portion to seal the end portion; reducing the inner pressure of the container 12 through the opening portion, that is, the operating fluid injection hole 16 of the throttled portion 11; injecting a predetermined amount of operating fluid such as pure water, or the like, not shown; pressure-bonding the seal portion 15 in the vicinity of the base of the throttled portion 11; cutting an unnecessary portion; and welding the seal portion 15.

Figure 7:
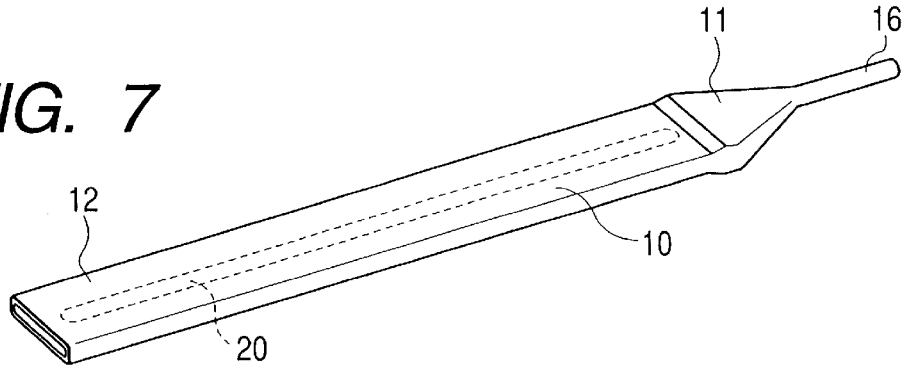
FIG. 7 is a perspective view of the heat pipe of the first embodiment after the container of the heat pipe is pressed.

However, to process a very thin type heat pipe extremely intended by the present invention, the heat pipe in the state in which the arbor 30 is taken out is set to another pressing jig than the aforementioned pressing jig; the container 12 portion of the first pipe 10 is pressed again while the vicinity of the throttled portion 11 is left, so that a shape shown in FIG. 7 and having a sectional structure shown in FIG. 2 is formed; sealing of a not-throttled end portion and injection of an operating fluid are performed in the same manner as in the aforementioned procedure to form a heat pipe; and finally press-shaping is carried out on the injection hole 16 to thereby form a seal portion 15. Thus, all the heat pipe processing steps are completed.

The reason why forming the throttled portion 11 and pressing are made in different steps is as follows. In the step of putting an operating fluid into the first pipe 10, pure water degassed and purified is injected into the deaerated container 12 after weighed. However, because the thin type heat pipe has a small flat gap and a small sectional area, it is difficult to inject the operating fluid into the container 12. Therefore, throttling of the injection hole 16 portion is performed after the injection of the operating fluid to thereby solve simultaneously the problem that the amount of the operating fluid is apt to be out of a control limit and the problem that materials are softened by welding heat of the seal portion 15.

That is, the inner pressure of the container 12 is reduced through the injection hole 16 and an operating fluid not shown is injected into the first pipe 10. If the inner space volume of the vicinity of the throttled portion 11 is relatively large in this case, not only sufficient reduction of the inner pressure of the container 12 can be obtained but also variation in the amount of injection can be controlled to be very small because the injection speed of the operating fluid is not disturbed. Further, when the injection hole 16 is sealed after the injection of the operating fluid, material softening in a region of from the injection hole 16 to the throttled portion 11 is induced by welding heat. However, when the throttled portion 11 and its vicinity are pressure-bonded to eliminate the inner space of the container 12 in terms of the processed thickness of the heat pipe to thereby accelerate hardening of the container 12 material, the hardness of the material softened by welding heat is substantially returned to an original value (before welding) by the pressure molding. Although the above description has been made upon the throttled portion 11 in one end portion, this processing/hardening process can be applied also to the pressed portion 14 in the other end portion if necessary.

The operation of the heat pipe having the aforementioned configuration will be described below. A pipe wick as the second pipe 20 deformed like a pair of spectacles is formed in the inside of the container 12 having a groove wick in its inner wall. When the heat pipe is operated, of course, also a portion of the outer circumference of the pipe wick touching the inner wall of the container 12 serves as an effective wick. However, the inside of the pipe wick is more insulated from the vapor passage of the vaporization portion of the heat pipe than the aforementioned wick. Accordingly, there is no capillary pressure limit and no scattering limit, so that the pipe wick serves as a main wick for the operating fluid fed back from the condensation portion.

Further, the reason why the sectional shape of the second pipe 20, that is, the pipe wick is formed like a pair of spectacles having circular arc portions 21 is as follows. Not only the shape is effective as a core for suppressing depression of the container 12 when the container 12 is processed so as to be flattened but also there is also provided a means for keeping the pumping operation of the wick optimum.

FIG. 3 is a model view showing the operation of the heat pipe in the aforementioned embodiment. That is, in FIG. 3, the arrow solid line expressed in the inside of the container 12 shows a liquid stream of the operating fluid, and the arrow broken line shows a vapor stream of the operating fluid. The operating fluid vaporized in the vaporization portion flows as a vapor stream in the outside of the pipe wick. The operating fluid is liquidified in the condensation portion. A larger part of the operating fluid circulates in the inside of the pipe wick.

Because the vapor passage and the liquid passage are provided separately as described above, there is no capillary pressure limit and no scattering limit caused by vapor stream pressure. Accordingly, the narrow wall distance of the container 12 can be reduced extremely. Although the role of the groove wick is not shown obviously in the model view shown in FIG. 3, the wick has not only the role of assisting the pumping operation for circulation of the operating fluid in the axial direction but also the role of transmitting heat in the cross-sectional direction.

Although the embodiment has been described upon the case where a groove wick material is used in the inside of the first pipe 10, it is a matter of course that the groove wick is not always required in the case where the heat pipe has a small sectional area and a relatively short length, and in some cases, it is better to provide no groove wick for reduction of thickness. Further, the pipe wick material deformed like an ellipse or like a pair of spectacles in advance may be used. It is a matter of course that the pipe wick material is not always limited to the pipe section and that any wick assisting material such as a wire material, or the like, can be inserted in the inside of the pipe wick suitably. Further, each of the pipes and the operating fluid are not limited to copper and pure water respectively. Even in the case where another known material is used, the same thin type heat pipe as described above can be obtained. Further, the number of pipe wicks as the second pipe 20 is not limited to one. It is a matter of course that a plurality of pipe wicks having the same or different shapes may be prepared.

Figure 8:
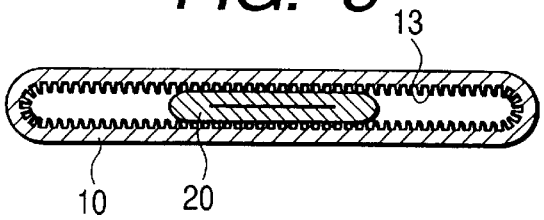
FIG. 8 is a section, as a second embodiment of the present invention, along the A—A line viewed in the direction of the arrow in FIG. 1.
Figure 9:
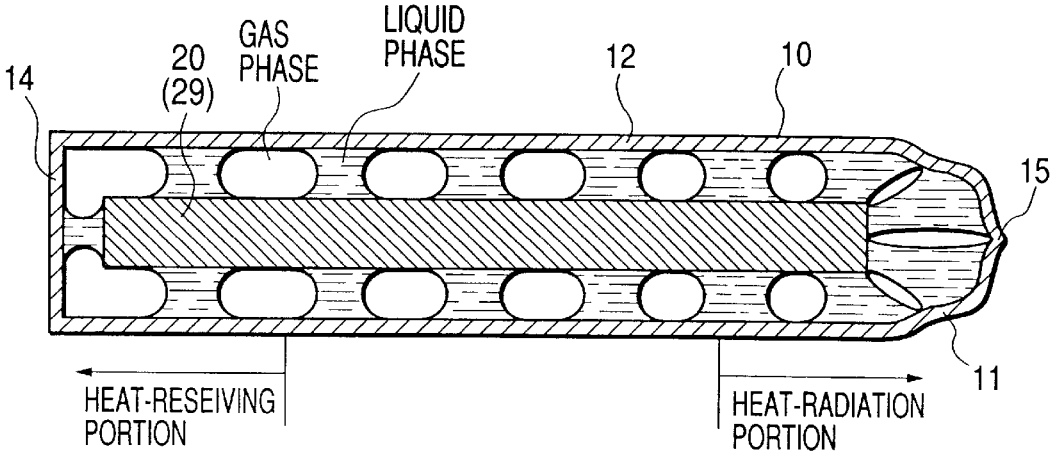
FIG. 9 is a section of the heat pipe, as the second embodiment of the present invention, viewed in the axial direction.

A second embodiment of the present invention will be described below. In the second embodiment, FIG. 8 is a section along the A—A line viewed in the direction of the arrow in FIG. 1. FIG. 9 is an axial section of the heat pipe depicted in FIG. 1. In the description of the second embodiment with reference to FIGS. 1, 8 and 9, the description of identical or like parts with respect to the first embodiment will be omitted. As described above, the first pipe 10 is flattened. As shown in FIG. 8, grooves 13 are formed in the inside of the first pipe 10 and a second pipe 20 having a smaller length than the effective length of the container 12 is buried in the inside of the first pipe 10. As shown in FIG. 8, the second pipe 20 is shaped so that the inner space is squashed. Here, the grooves 13 form a groove wick of the first pipe 10, and the second pipe 20 forms: a plate/rod-like wick.

In a more specific example, the first pipe 10 is formed of a pipe material of oxygen-free copper or phosphor-deoxidized copper having a thickness of about 0.18 mm and an outer diameter of from about 3 mm to about 15 mm, the pipe material being processed to form grooves with a height of about 0.12 mm. After the pipe material is cut, for example, into a length of about 180 mm, one end portion is throttled to have a small diameter for injection of an operating fluid. The second pipe 20 is formed of oxygen-free copper or phosphor-deoxidized copper having a thickness of from 0.12 mm to 0.25 mm and an outer diameter of from about 1.2 mm to about 3 mm, the pipe material being cut into a smaller length than the effective length of the container 12 which is the first pipe 10, and shaped so that the inner space is squashed.

The method for processing a heat pipe in the second embodiment is the same as described above with reference to FIGS. 4 through 7, so that the description thereof will be omitted.

In FIG. 4, one end portion of the first pipe 10 is throttled to reduce the diameter for injecting an operating fluid, so that a throttled portion 11 and an operating fluid injection hole 16 are formed. Then, an arbor 30 of piano wire or phosphor bronze is put through the first pipe 10 from the other end portion of the first pipe 10, the second pipe 20 is inserted in the inside of the throttled container 12 and the pipes 10 and 20 are set to a pressing jig. Thus, the second pipe 20 is temporarily fixed substantially at the center portion of the inside of the container 12 as shown in FIG. 4. While this state is kept;, the second pipe 20 is pressed so as to be flattened with size control in which the contour of the second pipe 20 is fixed to the inner wall of the first pipe 10. After a shape shown in FIG. 6 and having a sectional state shown in FIG. 5 is obtained, the arbor 30 is taken out.

Further, after pressed, the pressed portion 14 is welded or brazed so as to be sealed. The inner pressure of the container 12 is reduced through the throttled portion 11. A predetermined amount of operating fluid such as pure water, or the like, is injected. The vicinity of the base of the throttled portion 11 is pressure-bonded. After an unnecessary portion is cut, the throttled portion 11 is welded. After a heat pipe is completed once, the heat pipe is flattened into a target final shape.

In the aforementioned other processing method, the heat pipe in the state in which the arbor 30 is taken out is set to another pressing jig than the aforementioned pressing jig; the heat pipe is pressed again while the vicinity of the throttled portion 11 is left, so that a shape shown in FIG. 7 and having a sectional structure shown in FIG. 2 is formed; sealing of the pressed portion 14 and injection of an operating fluid are performed in the same manner as in the aforementioned procedure to form a heat pipe; and the throttled portion 11 is finally shaped by pressing. Thus, all the heat pipe processing steps are completed.

The reason why the processing for obtaining the final shape and pressing of the whole heat pipe or the throttled portion 11 are performed in different steps is the same as described above in the first embodiment, and the description thereof will be omitted.

The operation of the heat pipe having the aforementioned configuration in the second embodiment will be described below. A plate/rod-like wick of the second pipe 20 having the inside squashed is formed in the inside of the container 12 having a groove wick in its inner wall. When the heat pipe is operated, a portion of the outer circumference of the plate/rod-like wick touching the inner wall of the container 12 serves as an effective wick. Further, the loop-like heat pipe is formed on the whole inner circumference of the container. Accordingly, there is little influence of the capillary pressure limit and the scattering limit.

Further, because the loop-like heat pipe structure is provided, when the vapor passage must be set to be very small, the amount of the operating fluid can be set to be relatively large, that is, not smaller than 25% of the space volume of the container to thereby accelerate generation of a pressure change vibration stream of vapor bubbles caused by the nuclear boiling of the operating fluid to perform heat transport effectively.

Further, FIG. 9 is a model view for explaining the operation of the heat pipe in the aforementioned embodiment in the case where the thickness of the flattened. heat pipe is set to be small. No groove or mesh wick is provided in the inner wall of the container 12. In FIG. 9, the space expressed in the inside of the container 12 shows a gas phase, and the broken line portion shows a liquid phase. When the heat-receiving portion is heated, the operating fluid is nuclear-boiled to form vapor bubbles and, at the same time, generate pressure vibration wave. Thus, heat transport is performed on the basis of the phenomenon that all vapor bubbles taking latent heat are expanded/contracted so as to be moved to the heat radiation portion side.

The capillary pressure limit and the scattering limit depend on the surface tension of the operating fluid. However, there is no capillary pressure limit and no scattering limit caused by vapor stream pressure in a general heat pipe because heat transport is performed by a slag stream as described above. Accordingly, the narrow wall distance of the container can be reduced extremely.

Although the role of the groove or mesh wick is not shown obviously in the model view shown in FIG. 9, the wick is set when the narrow wall distance of the container is not required to be reduced extremely and mainly has the role of assisting the pumping operation for circulation of the operating fluid in the axial direction and the role of transmitting heat in the cross-sectional direction.

Although the second embodiment has been described upon the case where a groove wick material is used in the inside of the first pipe 10, it is a matter of course that the groove wick is not always required if the heat pipe has a small sectional area and a relatively short length, and that, in some cases, it is preferable to provide no groove wick for reduction of thickness. Further, the pipe wick material deformed like an ellipse or like a pair of spectacles in advance may be used. It is a matter of course that the pipe wick material is not always limited to the pipe section and that any wick assisting material such as a wire material, or the like, can be inserted in the inside of the pipe wick suitably. Further, each of the pipes and the operating fluid are not limited to copper and pure water respectively. Even in the case where another known material is used, the same thin type heat pipe as described above can be obtained. Further, the number of pipe wicks as the second pipe 20 is not limited to one, that is, a plurality of pipe wicks may be prepared.

Figure 10:
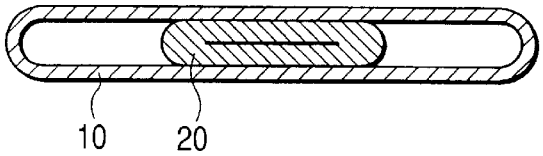
FIG. 10 is a section of the heat pipe as a third embodiment of the present invention.

The processing/hardening method in the second embodiment can be applied also to the pressed portion 14 if necessary. Although the second embodiment has been described above upon the case where a wick formed from grooves 13 is provided in the inner wall of the container 12, the wick may be formed from mesh, or the like, or no wick may be provided as shown in FIG. 10 which shows a third embodiment. FIG. 10 shows the third embodiment which is the same as the second embodiment or equivalent to the second embodiment except that no groove 13 is provided in the inside of the container 12. Accordingly, the description thereof will be omitted. The heat pipe in the third embodiment is effective for reduction of thickness.

Figure 11:
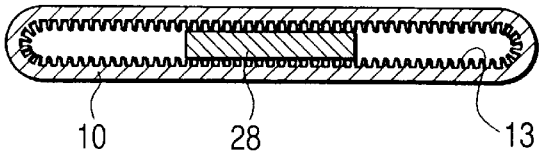
FIG. 11 is a section of the heat pipe as a fourth embodiment of the present invention.
Figure 12:
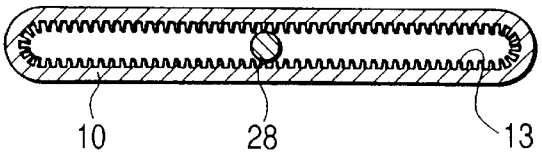
FIG. 12 is a section of the heat pipe as a fifth embodiment of the present invention.

Although the second and third embodiments have been described upon the case where the second pipe 20 is used as a core which serves also as a partition plate/rod for forming a loop-like heat pipe, it is a matter of course that the same effect as described above can be obtained when a pipe-like partition plate/rod 28 formed from mesh, braided wire, or the like, is used as shown in FIG. 11 showing a fourth embodiment or when a partition plate/rod 28 not shaped like a pipe but shaped like a rod or a plate is used as shown in FIG. 12 showing a fifth embodiment, in accordance with the flat narrow wall distance and required characteristic. Incidentally, the fourth and fifth embodiments are identical or equivalent to the first embodiment except that the second pipe 20 is replaced by another partition plate/rod 28. Accordingly, the description thereof will be omitted. Further, in the fourth and fifth embodiments, the grooves 13 may be omitted as shown in the third embodiment.

Further, there is a case where it is preferable to use the second pipe 20 deformed like an ellipse or like a pair of spectacles in advance. It is a matter of course that the second pipe is not always limited to the pipe section and that any wick assisting material such as a wire material, or the like, can be inserted in the Inside of the second pipe 20 suitably.

Further, each of the pipes and the operating fluid are not limited to copper and pure water respectively. Even in the case where any other known material is used, the same thin type heat pipe as described above can be obtained.

Figure 13:
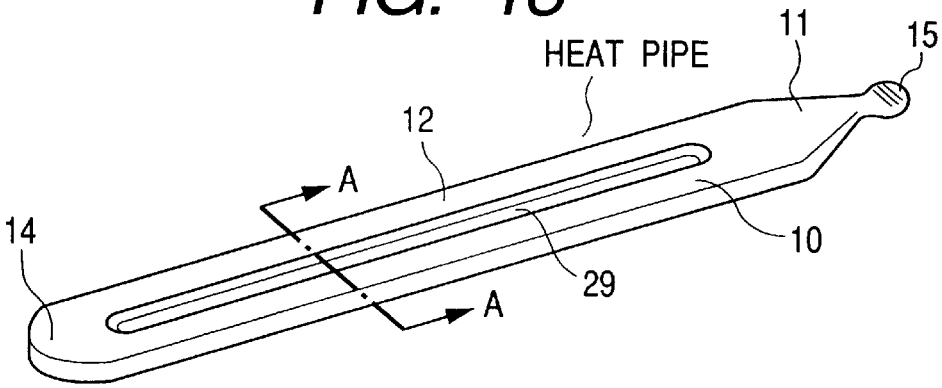
FIG. 13 is a section of the heat pipe as a sixth embodiment of the present invention.
Figure 14:
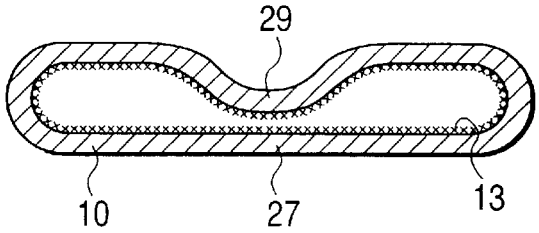
FIG. 14 is a section along the A—A line viewed in the direction of the arrow in FIG. 13.

A further embodiment will be described below. FIG. 13 is an overall perspective view of the heat pipe as a sixth embodiment of the present invention, and FIG. 14 is a section along the A—A line viewed in the direction of the arrow in FIG. 13. In FIGS. 13 and 14, the first pipe 10 as a body is constituted by a cylindrical pipe cut into a predetermined length and having one end provided as a throttled portion 11, the other end sealed and a container 12 formed between the opposite end portions. The throttled portion 11 serves as an operating fluid injection hole 16. In an assembling process, the injection hole 16 is sealed to make the inside of the first pipe 10 airtight. Further, a wick (groove wick) formed from grooves 13 is provided in the inner wall of the container 12.

The container 12 and the wick formed from grooves 13 will be described below in detail. A wall (hereinafter referred to as "depressed wall 29") depressed in the vicinity of the center portion of the inside of the container 12 having grooves 13 formed in its inner wall is brought into contact with a counter wall 27, so that the side surface of the contact wall forms an axial wick of the heat pipe. In this occasion, the container 12 is formed so that only one surface substantially in the:center portion of the first pipe 10 flattened is depressed. A sectional view of the container 12 is as shown in FIG. 14. Further, because the depressed wall 29 is configured to have a smaller length than the effective length of the container 12, a loop-like heat pipe is formed on the whole inner circumference of the container 12. Accordingly, there is formed a structure in which the influence of the capillary pressure limit and the scattering limit is little.

Figure 15:
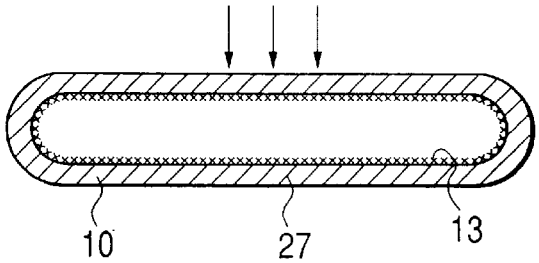
FIG. 15 shows the state before pressing in FIG. 14.

In a more specific example, the first pipe 10 is formed of a pipe material of oxygen-free copper or phosphor-deoxidized copper having a thickness of about 0.18 mm and an outer diameter of from about 3 mm to about 15 mm, the pipe material being cut into a length of about 180 mm and processed to form grooves with a height of about 0.12 mm in the inner surface. Further, the first pipe 10 is pressed in the direction of the arrow in FIG. 15 to form a depressed wall 29. The depressed wall 29 is molded to have a smaller length than the effective length of the container 12 which is a heat transmission portion of the first pipe 10. Further, one end of the first pipe 10 is throttled to have a small diameter for injection of an operating fluid to thereby form a throttled portion 11. Further, after being throttled or pressed, the other end of the first pipe 10 is welded or brazed so as to be sealed as a second seal portion 17. The inner pressure of the container 12 is reduced through the injection hole 16 in an end portion of the throttled portion 11. A predetermined amount of operating fluid such as pure water, or the like, is injected. The injection hole 16 is pressure-bonded. An unnecessary portion is cut and the injection hole 16 is welded to form a seal portion 15. After a heat pipe is completed once, a flattening process and a depressing process are performed simultaneously or separately to obtain a target final shape.

Figure 18:
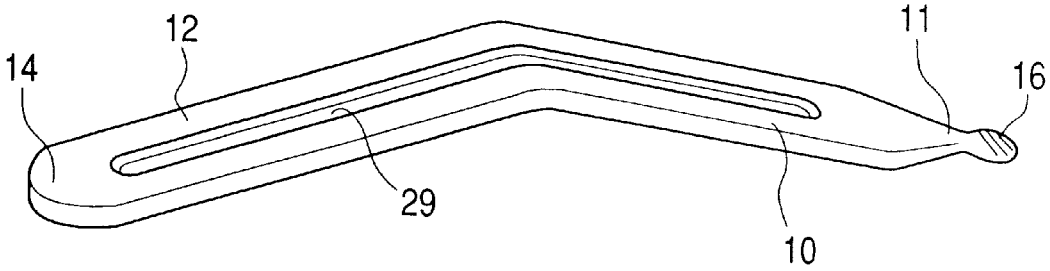
FIG. 18 is a perspective view of an L-shaped heat pipe.
Figure 19:
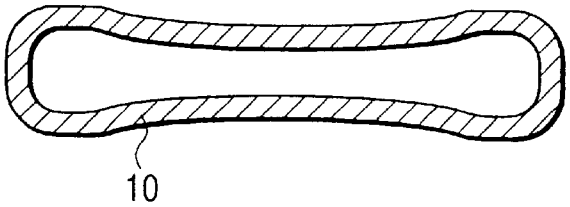
FIG. 19 is a section showing the case where a general depressed shape is given to the container.

When a general flattening/pressing process is executed in this case, opposite surfaces of the first pipe 10 are depressed inward as smooth curved surfaces as shown in FIG. 19. This phenomenon appears more remarkably when the first pipe 10 is deformed into an L shape, or the like, as shown in FIG. 18.

In the sixth embodiment, however, only one surface of the container 12 is forced into a depressed wall 29 shape. Accordingly, when the width of the heat pipe is not large, no special process is required because the wall surface of the counter wall 27 is corrected into a flat surface. When the width of the heat pipe is large, if the heat pipe is heated to a temperature, at least, not lower than 50□C to increase the vapor pressure of the operating fluid, it is possible to obtain a target shape easily.

Further, because the loop-like heat pipe structure is provided, when the vapor passage must be set to be very small, the amount of the operating fluid can be set to be relatively large, that is, not smaller than 25% of the space volume of the container to thereby accelerate generation of a pressure change vibration stream of vapor bubbles caused by the nuclear boiling of the operating fluid to perform heat transport effectively.

The operation of the heat pipe in the sixth embodiment will be described below with reference to FIG. 9. FIG. 9 is a model view for explaining the operation of the heat pipe in the sixth embodiment in the case where the thickness of the flattened heat pipe is set to be small. No groove or mesh wick is provided in the inner wall of the container 12 for convenience of description. In FIG. 9, the space expressed in the inside of the container 12 shows a gas phase, and the horizontal line portion shows a liquid phase. When the heat-receiving portion is heated, the operating fluid is nuclear-boiled to form vapor bubbles and, at the same time, generate pressure vibration wave. Thus, heat transport is performed on the basis of the phenomenon that all vapor bubbles taking latent heat are expanded/contracted so as to be moved to the heat radiation portion side.

Incidentally, the direction and shape of the depressed wall 29 in the sixth embodiment are not limited specifically. Any other shape such as a triangle, a circle, a trapezoid, or the like, may be used suitably or any other method in which the opposite wall surfaces are depressed whereas a heat-receiving structure is provided by another collector may be employed easily.

Figure 16:
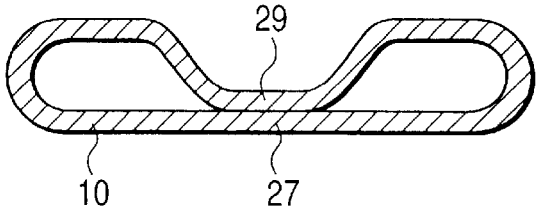
FIG. 16 is a section of the heat pipe as a seventh embodiment of the present invention.
Figure 17:
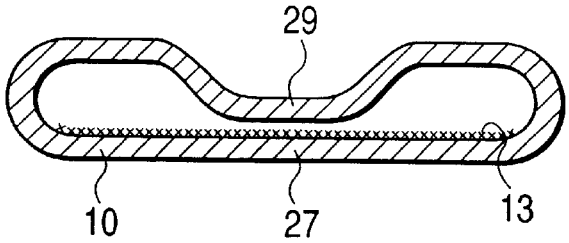
FIG. 17 is a section of the heat pipe as an eighth embodiment of the present invention.

It is a matter of course that the grooves 13 used in the aforementioned embodiment of the present invention may be replaced by a mesh or wire wick. As described above partially in the model shown in FIG. 9, the wick is not always required on the whole inner surface and, in some cases, the wick may not be provided for reduction of thickness in accordance with the flat narrow wall distance and required characteristic. These examples are shown as seventh and eighth embodiments in FIGS. 16 and 17 respectively. Incidentally, the seventh and eighth embodiments are identical or equivalent to the sixth embodiment except the difference between the presence/absence of the grooves 13, so that the description thereof will be omitted.

Further, to protect depressed walls from inner pressure under the operation of the heat pipe at a high temperature, welding such as spot welding, or the like, may be performed. Further, each of the pipes and the operating fluid are not limited to copper and pure water respectively. Even in the case where a known material is used, the same thin type heat pipe as described above can be obtained.

Figure 20:
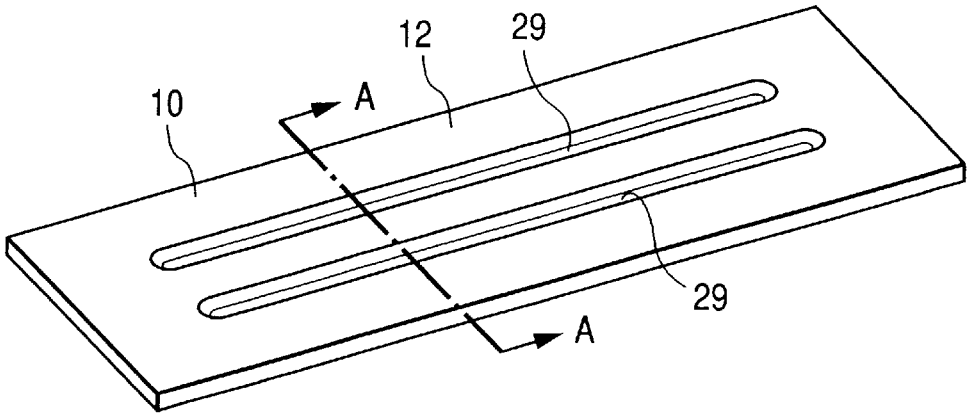
FIG. 20 is a perspective view of the heat pipe as a ninth embodiment of the present invention.
Figure 21:
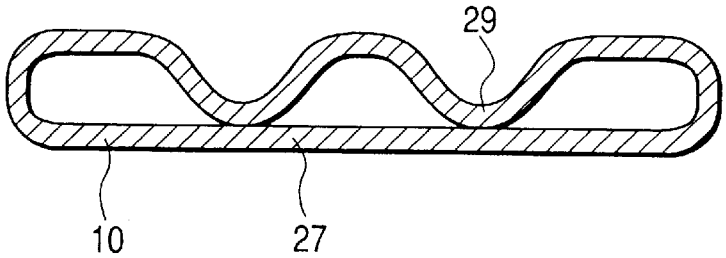
FIG. 21 is a section-along the A—A line viewed in the direction of the arrow in FIG. 20.

An embodiment in which the configuration of the heat pipe in the sixth embodiment shown in FIG. 13 is changed to obtain the operation of the second pipe 20 in the first embodiment shown in FIG. 1, is shown as a ninth embodiment in and after FIG. 20. FIG. 20 is a perspective view showing the heat pipe as the ninth embodiment of the present invention. In the ninth embodiment, the second pipe 20 shown in the first embodiment is constituted by depressed walls 29. The depressed walls 29 are formed by pressing the first pipe 10 in the same manner as in the depressed wall 29 shown as the sixth embodiment in FIG. 13. The press size is set to be shorter than the length of the heat pipe in the axial direction. Accordingly, a section viewed in the axial direction is as shown in FIG. 3, and a section along the A—A line viewed in the direction of the arrow in FIG. 20 is as shown in FIG. 21. A passage of the operating fluid for the heat pipe is formed between the depressed walls 29, so that the operating fluid circulates as shown in FIG. 3.

Figure 22:
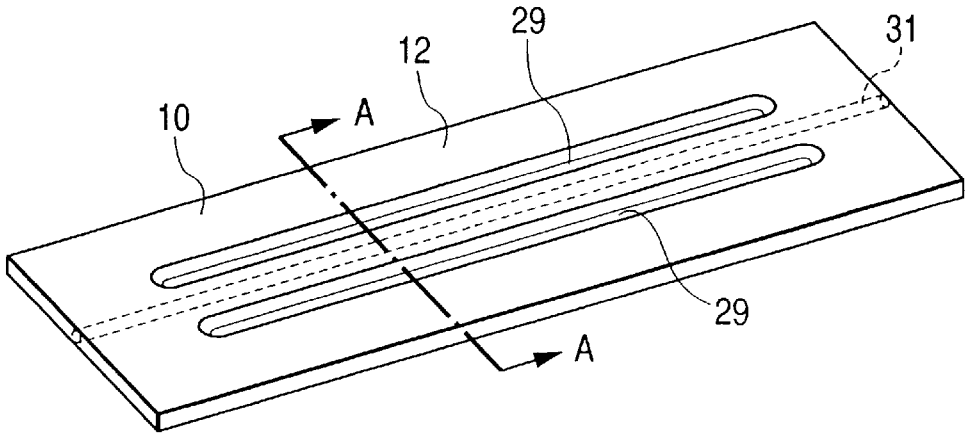
FIG. 22 is a perspective view of the heat pipe as a tenth embodiment of the present invention.
Figure 23:
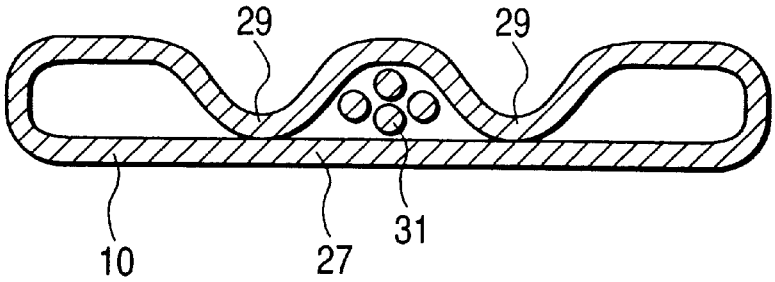
FIG. 23 is a section along the A—A line viewed in the direction of the arrow in FIG. 22.

A wick material 31 formed from wire, braided wire, or the like, may be disposed between the two depressed walls 29 in the ninth embodiment. This configuration is shown as a tenth embodiment in FIG. 22 and a section along the A—A line viewed in the direction of the arrow in FIG. 22 is shown in FIG. 23.

Figure 24:
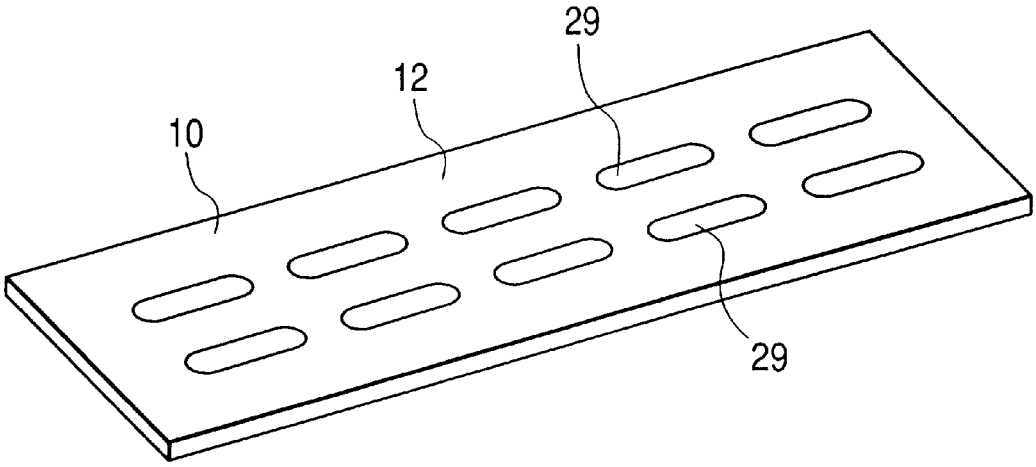
FIG. 24 is a perspective view of the heat pipe as an eleventh embodiment of the present invention.
Figure 25:
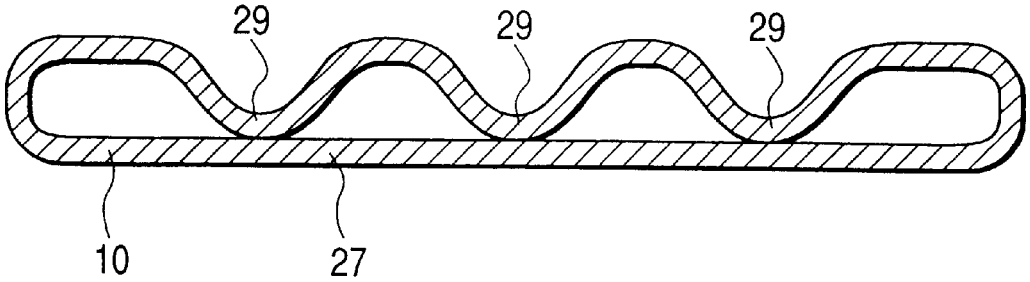
FIG. 25 is a section of the heat pipe as a twelfth embodiment of the present invention.

As the press configuration of depressed walls 29 of the heat pipe in the ninth and tenth embodiments, a plurality of depressed walls 29 disposed at intervals of a predetermined distance may be formed as shown in FIG. 24 showing an eleventh embodiment or depressed walls 29 as shown in FIG. 25 showing a twelfth embodiment may be formed. FIG. 25 shows the case where three depressed walls 29 are provided in the axial direction. In FIG. 25, the same operation and effect as described above can be obtained even in the case where a wick material 31 shown in FIG. 23 is provided. Although the ninth to eleventh embodiments have been described above upon the case where one flat surface of the flat first pipe 10 is pressed to form depressed walls 29, the depressed walls 29 may be formed not in one flat surface but in opposite flat surfaces because the plurality of depressed walls 29 are provided.

As described above in detail, according to the first embodiment of the present invention, when a first pipe having a contour selected on the basis of the required container width and a second pipe, rod, plate, mesh, or a plurality of second pipes, rods, plates, meshes as a wick material selected on the basis of the required container thickness are combined optimally, not only taking-in/out of a core in accordance with a process required for accurate control inevitable to a flattening process and particularly to thin-plate processing in the flattening process, heating/shaping for deforming/correcting the depression after completion of the heat pipe, etc. can be eliminated but also a wick or a loop-like heat pipe exhibiting characteristic excellent in circulation of an operating fluid can be obtained. Accordingly, a heat pipe in which its thickness can be reduced extremely, and a method for processing the heat pipe, can be obtained.

Further, because the heat pipe per se is difficult to be deformed, variation in individual characteristic is small. Accordingly, the heat pipe has various excellent characteristics so that, for example, the heat pipe is allowed to be bent after completion of the heat pipe.

Further, in the sixth to twelfth embodiments, a pipe having a contour selected on the basis of the required container width and a wick selected on the basis of the required container thickness are combined optimally so that a general round rod-like heat pipe is suitably processed into a flat shape in accordance with the customer's request after completion of the heat pipe. Not only standardization of the heat pipe process and suppression of goods in stock can be attained but also the hardness of a flat heat pipe requiring flatness specially as to the problem in material softening caused by welding heat, or the like, can be recovered on the basis of age-hardening in processing.

Further, not only provision of a core and the special correction of the heat pipe for correcting depression after completion of the heat pipe can be eliminated but also a loop-like heat pipe exhibiting characteristic excellent in circulation of an operating fluid can be obtained. Accordingly, a heat pipe in which its thickness can be reduced extremely, and a method for processing the heat pipe, can be obtained.

Further, because the heat pipe is deformed after completion of the heat pipe, the heat pipe has various excellent characteristics so that, for example, variation in individual characteristic is reduced.

What is claimed is:

1. A heat pipe comprising:

a first pipe;

at least one second wick pipe having a relatively small diameter compared with said first pipe;

said at least one second wick pipe being inserted in said first pipe so as to be fixed substantially at a center portion of said first pipe, said second wick pipe being fixedly arranged between narrow walls of said first pipe so that space is provided in the inner circumference of said first pipe in the direction of width of said first pipe;

said first pipe and said second wick pipe being flattened so that space is provided between an outer circumference of said at least one second wick pipe and an inner circumference of said first pipe in the direction of width of said first pipe; and an operating fluid put into said first pipe, said first pipe being sealed at its opposite ends, wherein said second wick pipe is deformed like a pair of spectacles in section.

2. A heat pipe comprising:

an elongated first pipe; and a second wick pipe disposed inside said first pipe;

said first pipe and said second wick pipe being flattened so that space is provided between an outer circumference of said second wick pipe and an inner circumference of said first pipe in the direction of width of said first pipe and said outer circumference of said second wick pipe engages said inner circumference of said first pipe in the direction of height of said first pipe; and an operating fluid put into said first pipe, said first pipe being sealed at its opposite ends, wherein said second wick pipe has concave upper and lower surfaces deformed like a pair of spectacles in cross-section.

3. A heat pipe comprising:

an elongated flat container extending in a longitudinal direction;

a wick member elongated in said longitudinal direction, said member being fixedly arranged substantially centrally between narrow walls of said container so that space is provided between an outer circumference of said wick member and an inner circumference of said container in the direction of width of said container and said outer circumference of said wick member engages said inner circumference of said container in the direction of height thereof; and an operating fluid put into said container, said container being sealed at its opposite ends, wherein said wick member is a flat hollow pipe and said hollow pipe has concave upper and lower surfaces deformed like a pair of spectacles in cross-section.

* * * * *